United States Patent [19]

Plaschkes

[11] Patent Number: 4,924,938

[45] Date of Patent: May 15, 1990

[54] HEAT EXCHANGER BASE UNITS AND MODULES

[75] Inventor: Michael Plaschkes, Kibbutz Magen, Israel

[73] Assignee: Plastic Magen, Israel

[21] Appl. No.: 113,177

[22] Filed: Oct. 23, 1987

[30] Foreign Application Priority Data

Nov. 5, 1986 [IL] Israel ..... 80504

[51] Int. Cl.[5] ..... F28F 3/00

[52] U.S. Cl. ..... 165/158; 165/164; 165/145

[58] Field of Search ..... 165/158, 164, 165, 166, 165/145

[56] References Cited

U.S. PATENT DOCUMENTS

| | | | |
|---|---|---|---|
| 158,433 | 1/1875 | Munzinger | 165/145 |
| 859,012 | 7/1907 | Riblet | 165/158 |
| 1,024,554 | 4/1912 | Carter et al. | 165/145 |
| 1,067,689 | 7/1913 | Spots | 165/145 |
| 1,940,338 | 12/1933 | Wallis | 165/145 |
| 1,961,290 | 6/1934 | Gerhardt | 165/158 X |
| 2,481,149 | 9/1949 | Peterson | 165/145 X |
| 2,750,159 | 6/1956 | Ebner | 165/145 X |
| 2,821,369 | 1/1958 | Hilliard | 165/164 X |
| 3,342,729 | 9/1967 | Strand | 210/638 X |
| 3,414,052 | 12/1968 | Chojnowski et al. | 165/164 |
| 3,907,026 | 9/1975 | Mangus | 165/164 X |
| 4,667,734 | 5/1987 | Langle | 165/145 |

FOREIGN PATENT DOCUMENTS

| | | | |
|---|---|---|---|
| 853294 | 8/1952 | Fed. Rep. of Germany | 165/158 |
| 2509028 | 1/1983 | France | 165/145 |

*Primary Examiner*—Carl D. Price

*Attorney, Agent, or Firm*—Silverman, Cass & Singer, Ltd.

[57] ABSTRACT

The invention provides a base unit for a cross flow, tube and shell type heat exchanger comprising a substantially flat double frame consisting of an inner frame member delimiting an opening defining an element of a shell flow space, an outer frame member surrounding at least a portion of the inner member at a distance, which distance defines an element of a header flow space, at least two partition walls connecting the inner and the outer frame members and dividing the header element into an inlet header element and an outlet header element, the inlet and the outlet element being thereby separated from each other. The invention further provides a plurality of juxtaposed tubular members extending from one side of the opening to another side thereof, the spacing of the juxtaposed tubular members being such as to leave a clearance therebetween, one end of each of the tubular members communicating with the inlet header element and the other end of each of the tubular members communicating with the outlet header element. A module for a cross flow, tube and shell type heat exchanger is also described and claimed.

12 Claims, 6 Drawing Sheets

HEAT EXCHANGER BASE UNITS AND MODULES

BACKGROUND OF THE INVENTION

The present invention relates to a base unit for a cross flow, tube and shell type heat exchanger. It also relates to a heat exchanger module comprised of such base units, and to a heat exchanger comprised of such modules.

Heat exchangers are used in a great many industrial processes in which heat has to be transferred from a hot fluid which is consequently cooled, to a cold fluid which is consequently heated. While these devices are basically simple, having for instance no moving parts, there are nevertheless some serious problems which the designer of heat exchangers must solve. The material the heat exchanger is made of must not only withstand the temperature of the hot fluid, which is obvious, but must also be able to handle chemically aggressive media such as acids, bases, brines, alkalies, etc. Heat exchangers must also withstand mechanical stresses produced by the elevated pressures of the fluids handled as well as by thermal expansion. While there exist materials that meet these conditions, such as certain stainless steels, they are very expensive and not easily processed.

Attempts have therefore been made to make such heat exchangers from plastic materials. These attempts were, however, only partly successful, with such problems as distortion due to thermal stresses, tightness of seals, compactness, etc., still largely unsolved.

It is one of the objects of the present invention to overcome the disadvantages of the prior-art heat exchangers and to provide a plastic base unit for a tube and shell type heat exchanger which, integrally, contains the essentials of such a heat exchanger, namely a shell element and a tube element, from a plurality of which base units it is possible to produce a heat exchanger module which, in turn, can be combined with other such modules to produce a complete heat exchanger that is compact, stable, tightly sealed, not distorted by thermal stresses, withstands most chemical agents, and is easily disassembled for inspection, cleaning and possible replacement of components.

SUMMARY OF THE INVENTION

This the invention achieves by providing a base unit for a cross flow, tube and shell type heat exchanger comprising:

- a substantially flat double frame consisting of an inner frame member delimiting an opening defining an element of a shell flow space;
- an outer frame under surrounding at least a portion of said inner member at a distance, which distance defines an element of a header flow space;
- at least two partition walls connecting said inner and said outer frame member and dividing said header element into an inlet header element and an outlet header element, said inlet and said outlet element being thereby separated from each other;
- a plurality of juxtaposed tubular members extending from one side of said opening to another side thereof, the spacing of said juxtaposed tubular members being such as to leave a clearance therebetween, one end of each of said tubular members communicating with said inlet header element and the other end of each of said tubular members communicating with said outlet header element.

The invention further provides a module composed of a plurality of base units according to the invention, as well as a heat exchanger composed of one or more of said modules.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by the way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic overall view of the heat exchanger as assembled from modules composed of base units according to the invention;

Figure 2:
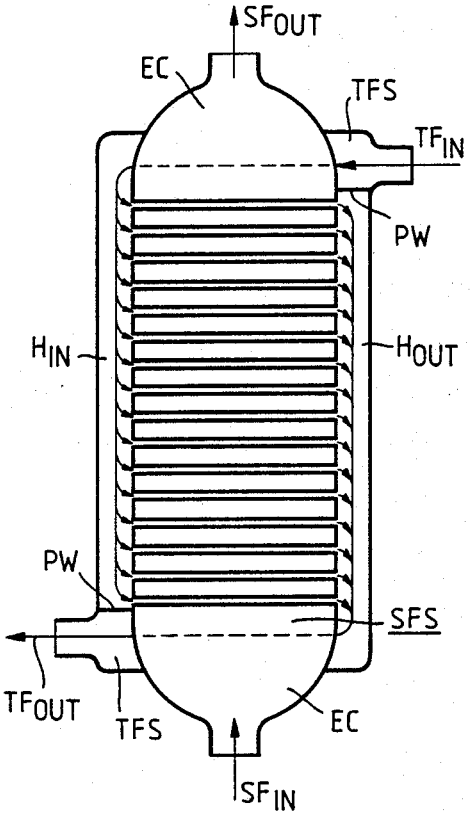
Figure 14:
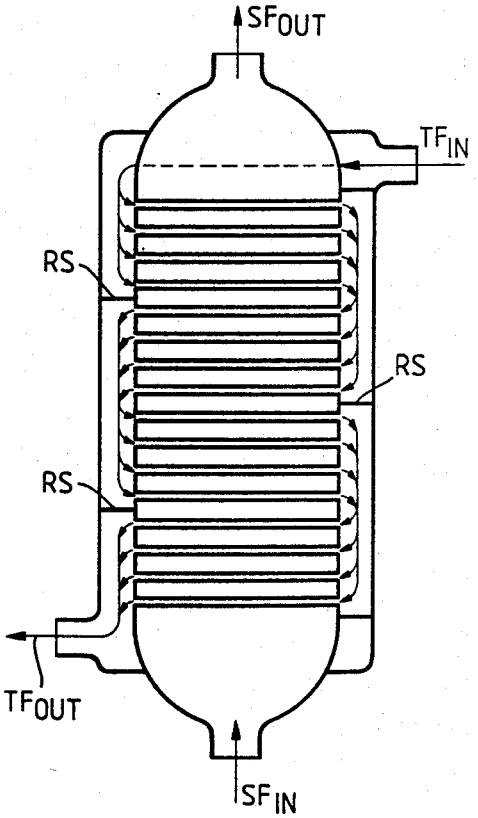
Figure 3:
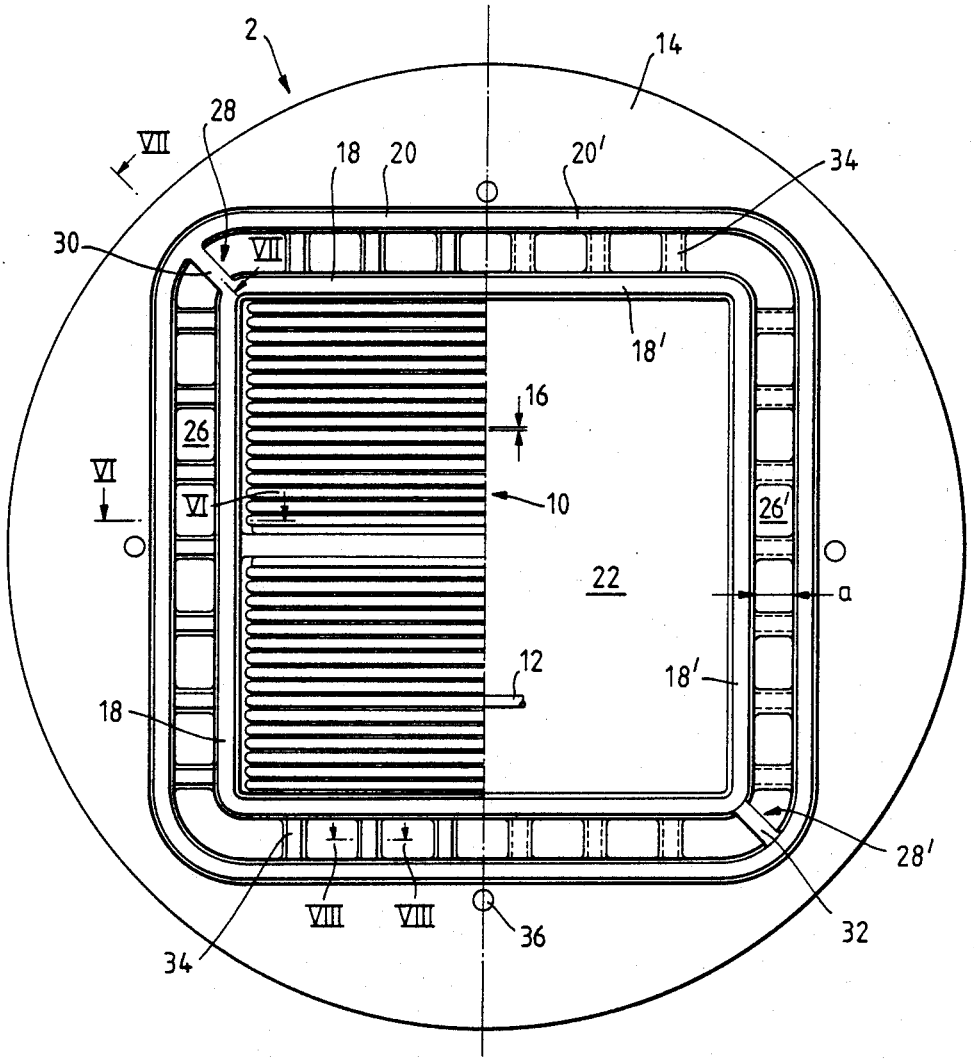
Figure 4:
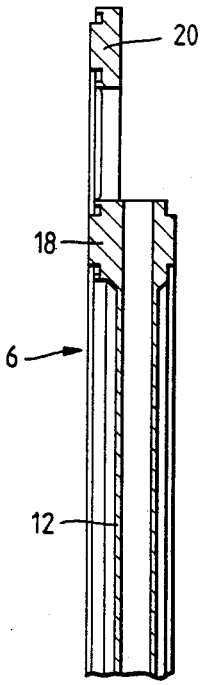
Figure 5:
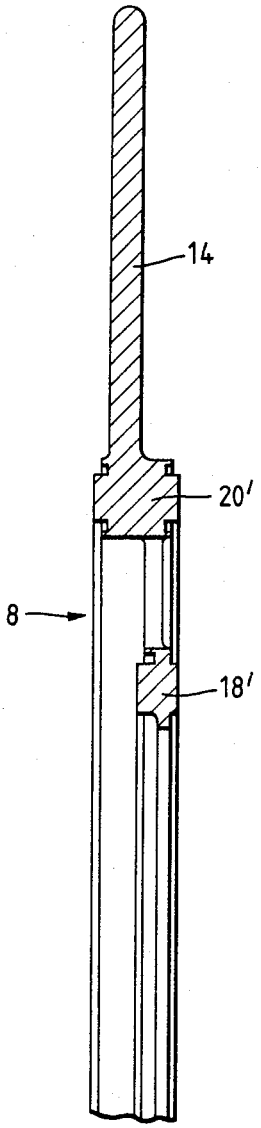
Figure 6:
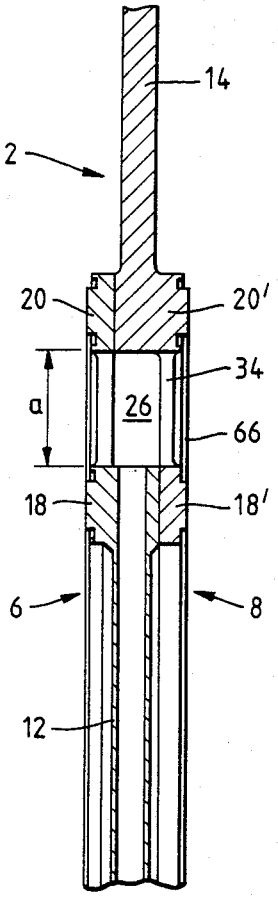
Figure 7:
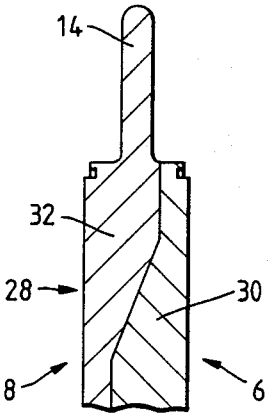
Figure 8:
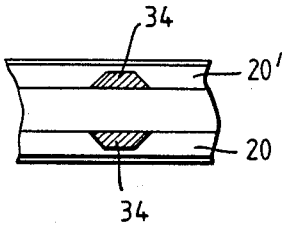
Figure 9:
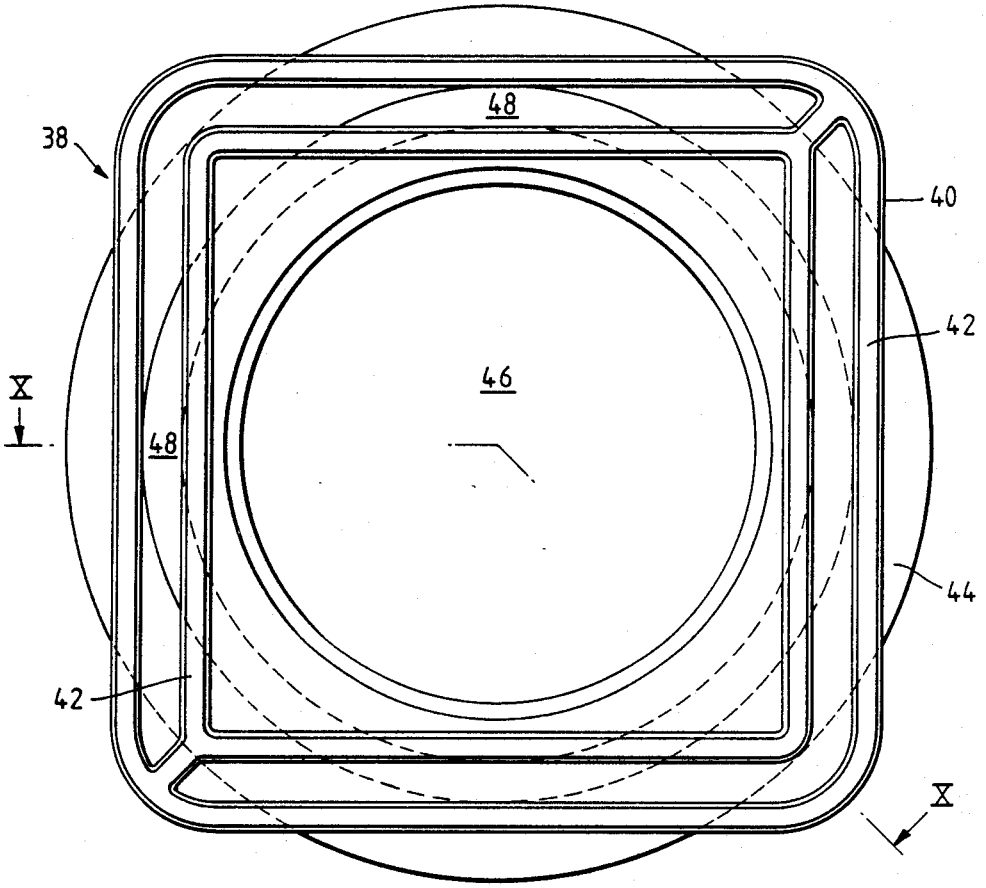
Figure 10:
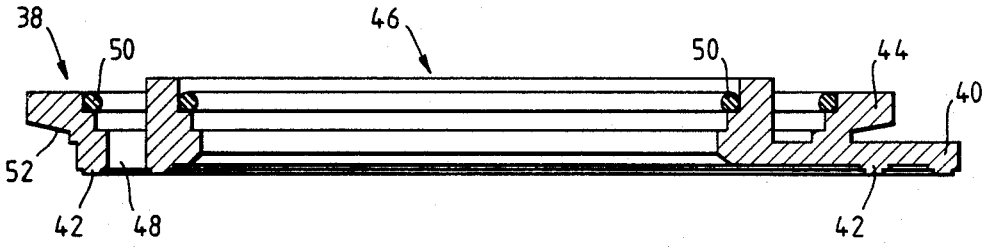
Figure 11:
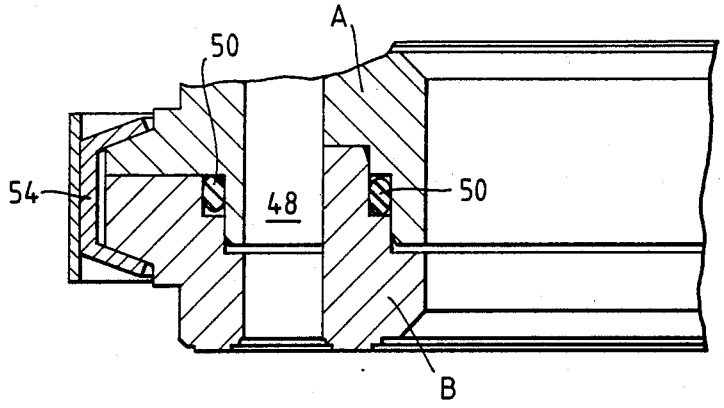
Figure 12:
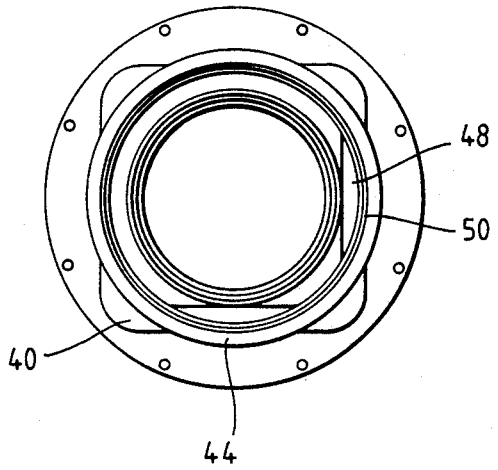
Figure 13:
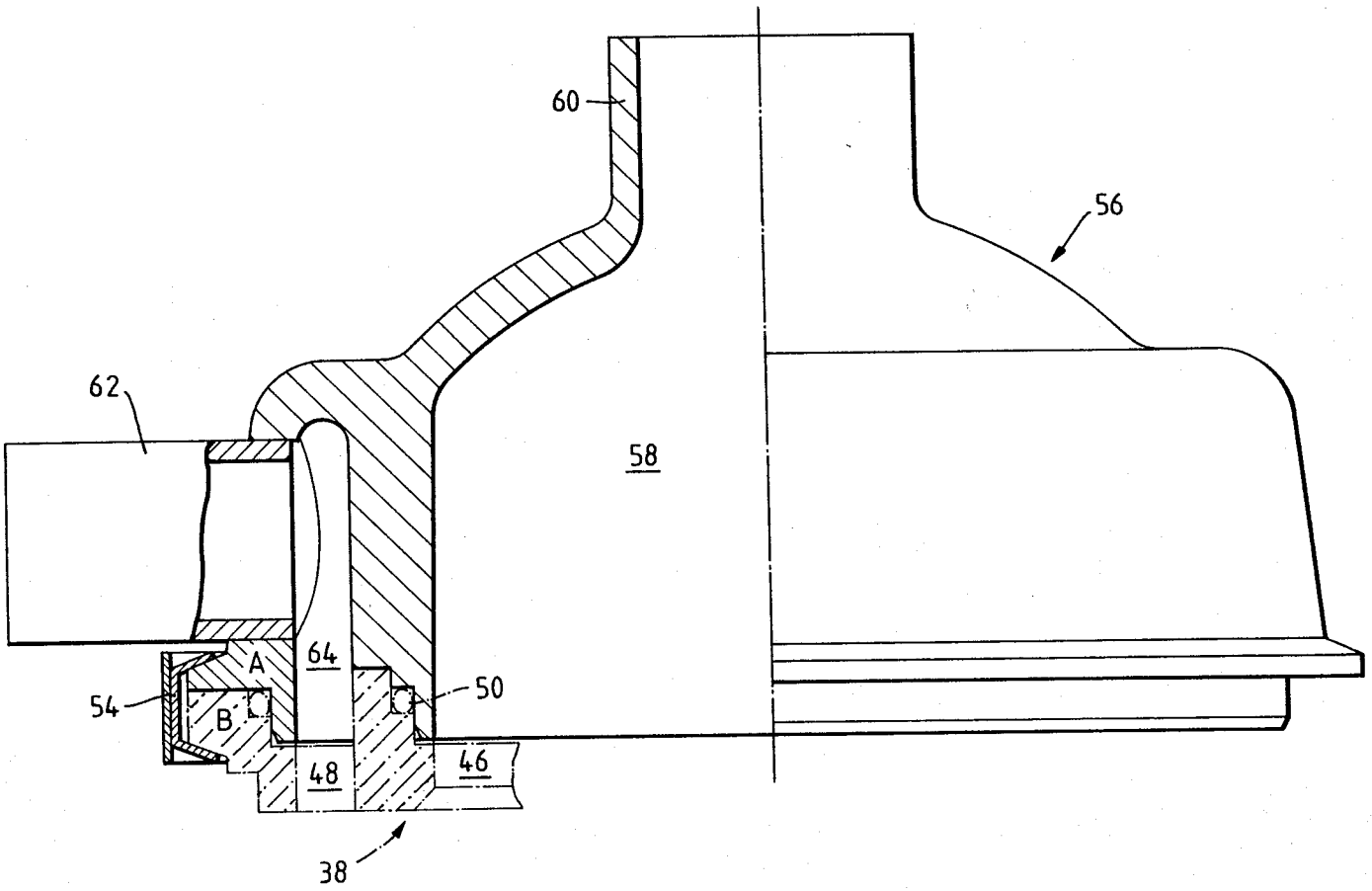

FIG. 2 schematically illustrates the operation of the heat exchanger according to the invention;

FIG. 3 is a front view of the base unit, with half of the tube-carrying subframe removed;

FIG. 4 shows a partial cross-sectional view of the tube-carrying subframe;

FIG. 5 is a similar view of the fin-carrying subframe;

FIG. 6 is a partial cross-sectional view of the base unit as assembled from its two subframes;

FIG. 7 is a view, in cross section along plane VII—VII, of the partition wall in FIG. 3;

FIG. 8 is a view, in cross section along plane VIII—VIII of FIG. 3, of the strip-like finger connecting the inner and outer frames;

FIG. 9 shows a rear view of one of the coupling flanges of each module;

FIG. 10 is a side view of the coupling flange, in cross section along plane X—X of FIG. 9;

FIG. 11 shows the matching portions of two coupled flanges, as well as the profile of the clamping strap in position;

FIG. 12 represents a front view of the coupling flange of FIG. 9, as attached to an outermost base unit of a module;

FIG. 13 is a view, in partial cross-section, of an end cap of the heat exchanger according to the invention, and FIG. 14 shows the heat exchanger of FIG. 2 as arranged to operate in the counterflow mode.

DESCRIPTION OF THE PREFERRED EMBODIMENTS

Figure 1:
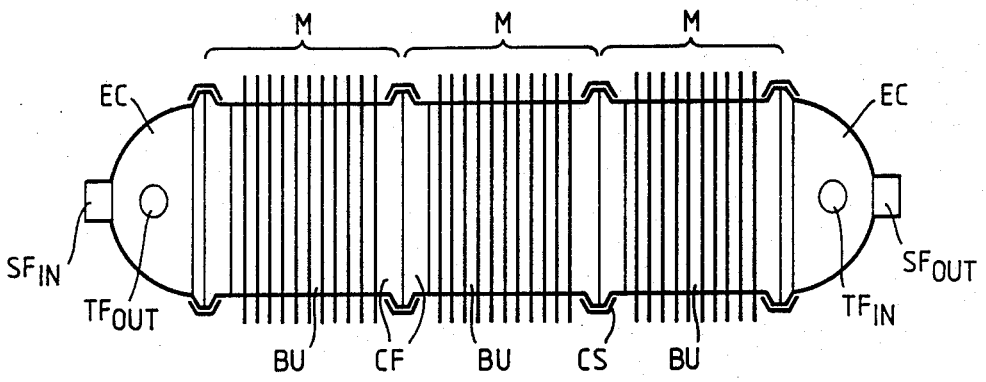

Referring now to the drawings, there is seen in FIG. 1 a schematic overall view of the heat exchanger as built up from various elements. The main purpose of this drawing is to introduce a terminology that will be adhered to throughout this specification, although carrying numerals.

The heat exchanger shown in FIG. 1 is seen to be comprised of several, in this example, three, modules M, each of which consists of a plurality of base units BU.

At each end, each module M is provided with coupling flanges CF which, as well be shown further below, are adapted to sealingly fit one another and, in assembly, are clamped together by means of clamping straps CS. To the free ends of the first and last module M are attached end caps EC, each of which is provided with two pipe sockets, one for the shell flow, SF and one for the tube flow TF. The subscripts IN and OUT stand for inlet and outlet.

The operation of the heat exchanger is schematically illustrated in FIG. 2, where it is seen that the shell flow space SFS is flanked by two manifolds or headers H, an inlet header $H_{IN}$ on the left, and an outlet header $H_{OUT}$ on the right. The inlet header $H_{IN}$ and the outlet header $H_{OUT}$ are connected via tubes T, each tube, as will be seen in the following, standing for an array of tubes located in a plane perpendicular to the plane of the drawing. The dome-shaped end caps EC are partly double-walled, producing an annular tube flow space TFS with which the pipe sockets $TF_{IN}$ and $TF_{OUT}$ communicate.

Further seen are partition walls PW which prevent the tube flow entering at $TF_{IN}$ from "short circuiting" and thus bypassing the tubes T. It is thus seen that the fluid entering at $TF_{IN}$ can exit at $TF_{OUT}$ only after flowing into the inlet header $H_{IN}$ and, thence, through the tubes T into the outlet header $H_{OUT}$. It is during its passage through the tubes T across the shell flow space SFS (hence "cross flow") that the tube fluid is brought into thermal contact with the shell fluid and heat exchange takes place.

As can be seen, the connection between the inlet and outlet headers $H_{IN}$ and $H_{OUT}$ via the tubes T is a parallel one. It will be shown further below that arrangements can be made to obtain a series connection as well. Such a connection is required if the heat exchanger is to be operated in the counterflow mode.

FIGS. 3 to 8 illustrate the base unit, a plastic molding now and in the following designated 2, which is seen to be comprised of a flat double frame 4 consisting of two subframes 6 and 8. In FIG. 3, which is a front view of the base unit 2, half the subframe 6 has been cut away to reveal the subframe 8. Subframe 6 (FIG. 4) carries an array 10 of tubes 12, while subframe 8 (FIG. 5) is provided with an annular, fin-like extension 14 which, in spite of its shape, has nothing to do with heat exchange, but merely serves as a mechanical reinforcement of the base units which, in their assembled form as heat exchanger modules, must withstand considerable inside pressures.

While subframe 6 is injection-molded, the tubes 12 comprising the array 10 are plastic extrusions and are permanently and tightly joined to the subframe 6 by a special process, whereby the tubes 10, cut to length, are introduced into the mold, held in position by locators and plugged up by cores, after which the subframe 6 is injection-molded over the end portions of the tubes 12. The high pressure and temperature of the injection-molding process causes a strong bond to be formed at the interface between the material of the extruded tubes 12 and the freshly injected material of subframe 6, a bond the mechanical strength of which should equal the strength of the base materials.

The spacing of the tubes 12 in the array 10 is such that a clearance or gap 16 is left between adjacent tubes 12. It is through these gaps 16 that the shell fluid flows, as will be explained in greater detail further below.

Subframe 8 having been prepared by injection molding in a separate mold, the two subframes 6 and 8 are welded together, to form the completed base unit 2 as shown in the partial, cross-sectional view of FIG. 6. Welding is carried out by the as such known "hot knife" method, in which a thin, suitably shaped heating element is introduced between the two subframes. When the contacting plastic surfaces have reached the softening point, the heating element is withdrawn, and the two subframes 6 and 8 are pressed against one another. Provision is obviously made for proper relative positioning of the two subframes prior to the welding contact.

The double frame 4 of both subframes consists of an inner frame member 18, 18', and an outer frame member 20, 20'. Together, the inner frame member 18, 18' delimit an opening 22 defining an element of a shell flow space 24. In the subframe 6, the shell flow space 24 is of course represented by the sum of all gaps 16.

The outer frame members 20, 20' surround the inner members 18, 18' at a distance a, which defines an element of two L-shaped header flow spaces 26, 26' extending, respectively, between two partition walls 28 located in opposite corners of the double frame and shown to a larger scale in FIG. 7. As can be seen, these walls are built up from two ribs 30 and 32, belonging to subframes 6 and 8, respectively.

It is now clear that the tubes 12 of the array 10 open, on one side, into the header element 26 which extends, in the counterclockwise sense, from the partition wall 28 in the upper left-hand corner of the double frame to the partition wall 28' in the low right-hand corner thereof, and on the other side, into the header element 26' which extends, in the same counterclockwise sense, from the partition wall 28' in the lower right-hand corner of the double frame to the partition wall 28 in the upper left-hand corner thereof. The two header flow space elements 26, 26' are thus separated from each other and no communication between them—in the plane of the base unit 2—is possible.

The inner frame member of each subframe is linked to its respective outer member not only by the respective patition-wall ribs 30 and 32, but also by a plurality of relatively thin and narrow finger-like strips 34 as clearly seen in FIG. 8.

When now a plurality of these base units 2 are butt-welded together at their frame members, inner members to inner members, outer members to outer members, with all partition walls in identical orientation, the shell flow space elements 24 become axially interconnected to form a shell flow space (SFS in FIG. 2), and the header elements 26, 26' become axially interconnected to become headers (H in FIG. 2). Proper stacking for butt-welding is facilitated by locating holes 36.

To turn this stacked and welded plurality of base units into a heat exchanger module 37 (M in FIG. 1) both ends of such a stack must be provided with coupling flanges to facilitate connection of such a module to other modules and/or to the end caps EC shown in FIG. 1.

FIGS. 9 and 10 represent a rear view and a cross-sectional view, respectively, of such a coupling flange 38. This flange 38 is seen to comprise a first portion 40 of substantially square shape, having butt-welding projections 42 conforming in shape to the shape of, and thus weldable to, the base unit double frame 4, and a second, substantially ring-shaped portion 44, whereby this coupling flange 38 is joinable to another, matching, coupling flange. The coupling flange 38 has a large central aperture 46 communicating, in assembly, with the shell flow space 24 (FIG. 3) and two smaller, lateral apertures 48, angularly offset by 90°, communicating, in assembly, with one of the headers, either 26 or 26', both of which, it will be remembered, have an L-shaped cross section. It will be appreciated that if the lateral apertures 48 of the flange 38 at one end of a module communicate with header 26 thereof, the apertures 48 of the flange 38 at the other module end must be arranged to communicate with the header 26'. Also provided are O-rings 50, seated in appropriate recesses. It is further seen that the rear surface 52 of the ring-shaped flange portion 44 is tapering. As becomes clear from FIGS. 11 and 13, this tapered section serves, in conjunction with a profiled clamping strap 54, to press the coupled flanges one against the other. Tightening of the straps is effected by means of the well-known tangential screw arrangement.

Because of the sealing requirements, the flange matching the flange of FIG. 10 has a slightly different cross section, as illustrated in FIG. 11 which shows portions of two matching flanges 38, type A and type B, as well as the profile of the clamping strip 54 (CS of FIG. 1).

FIG. 12 shows a coupling flange (type A) as attached to the first (or last) base unit 2 of a module 37 clearly showing the first, square, portion 40 and the second, ring-shaped, portion 44 as well as the O-rings 50 and the apertures 48.

Having again recourse to FIG. 1, it can be seen that the last component required to complete the heat exchanger comprised of the base units according to the invention is an end cap on each end (EC in FIG. 1). Such an end cap 56 is illustrated in FIG. 13.

The end cap 56 (which has a type A coupling flange: the end cap on the other side of the heat exchanger would have a type B flange) is seen to have a central space 58 communicating with the central aperture 46 of the matching (ghosted-in) coupling flange 38 (type B) of the module attached, and a central pipe socket 60 leading into this space, as well as lateral pipe socket 62 leading into an annular space 64 which, via the lateral apertures 48 of the coupling flange 38, communicates with one of the headers of the module 37 (either inlet or outlet). As is also clear from FIG. 2, the central pipe sockets 60 handle the shell fluid, and the lateral pipe sockets 2 handle the tube fluid. Obviously, the central space 58 and the annular space 64 are isolated from each other, for which purpose there if provided the inner O-ring 50, the outer O-ring sealing off the annular space 64 towards the outside. Also seen is the profiled clamping strap 54.

The heat exchanger described so far corresponds to the schematical drawing of FIG. 2, in which, as was explained earlier, the inlet header $H_{IN}$ and the outlet header $H_{OUT}$ are connected in parallel. However, in order to arrange for the heat exchanger to work in the often favored counterflow mode, the header connection via the tubes 12 has to be changed from parallel to series.

Such an arrangement is shown in FIG. 14, in which groups of, in this example, four base units are seen to be connected in series. This is achieved by two measures: (1) in the butt-welding stage, when the base units are stacked to form the modules, each group of base units, in this example four, are rotated, as group, by 90°, so that the partition walls 28 are no longer in alignment as was previously the case. In this way, the outlet header of one group becomes the inlet header of the next group (see FIG. 14), and (2) the interface between the outlet header element of the first base unit is a group (as seen in direction of flow) and the inlet header element of the last base element of the group immediately upstream, must be covered up. This is done in the butt-welding stage by introducing, prior to butt-welding, a tin, L-shaped rubber strip RS into the shallow recess 66 between the above defined two base units.

Attention must also be paid to the direction of the shell flow, which, obviously, must be in a direction opposite to the direction of the tube flow as advancing in the headers.

It should be understood that the number of base units in each module and the number of modules per heat exchanger are limited only by practical consideration.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A base unit for a cross flow, tube and shell type heat exchanger comprising:

a substantially flat double frame consisting of an inner frame member delimiting an opening defining a constituent element of a shell flow space;

an outer frame member surrounding at least a portion of said inner member at a distance, which distance defines a constituent element of a header flow space;

at least two partition walls connecting said inner and said outer frame members and dividing said header element into an inlet header element and an outlet header element, said inlet and said outlet element being thereby separated from each other;

a plurality of juxtaposed tubular members extending from one side of said opening to another side thereof, the spacing of said juxtaposing tubular members being such as to leave a clearance therebetween, one end of each of said tubular members communicating with said inlet header element and the other end of each of said tubular members communicating with said outlet header element; and said inner frame member being connected to its associated outer frame member by a plurality of relatively thin, striplike fingers.

2. A base unit for a cross flow, tube and shell type heat exchanger comprising:

a substantially flat double frame consisting of an inner frame member delimiting an opening defining a constituent element of a shell flow space;

an outer frame member surrounding at least a portion of said inner member at a distance, which distance defines a constituent element of a header flow space;

at least two partition walls connecting said inner and said outer frame members and dividing said header element into an inlet header element and an outlet header element, said inlet and said outlet element being thereby separated from each other;

a plurality of juxtaposed tubular members extending from one side of said opening to another side thereof, the spacing of said juxtaposed tubular members being such as to leave a clearance therebetween, one end of each of said tubular members communicating with said inlet header element and the other end of each of said tubular members communicating with said outlet header element; and said base unit double frame including two subframes, at least one of which carries said plurality of tubular members, and which subframes are sealingly and fixedly attached to one another.

3. The base unit as claimed in claim 2, wherein the inner frame member of at least one of said subframes is connected to its associated outer frame member by a plurality of relatively thin, striplike fingers.

4. The base unit as claimed in claim 2, wherein at least one of said subframes is provided with reinforcing means for the stiffening of said subframe in a radial direction.

5. The base unit as claimed in claim 4, wherein said reinforcing means is in the form of a circular, fin-like extension of said subframe substantially co-planar therewith.

6. A cross flow, tube and shell type heat exchanger comprising:

one or more modules, each including a stacked plurality of base units having a first and a last unit, each base unit including a substantially flat double frame having a shape and consisting of an inner frame member delimiting an opening defining an element of a shell flow space, an outer frame member surrounding at least a portion of said inner member at a distance, which distance defines an element of a header flow space, at least two partition walls connecting said inner and said outer frame members and dividing said header element into an inlet header element and an outlet header element, said inlet and said outlet element being thereby separated from each other, a plurality of juxtaposed tubular members extending from one side of said opening to another side thereof, the spacing of said juxtaposed tubular members being such as to leave a clearance therebetween, one end of each of said tubular members communicating with said inlet header element and the other end of each of said tubular members communicating with said outlet header element, each base unit sealingly and fixedly attached to one another at the frames thereof, inner frame member to inner frame member, outer frame member to outer frame member, whereby said shell flow space elements become interconnected to form a shell flow space and said header elements become interconnected to form headers, further comprising two coupling flanges sealingly and fixedly attached, respectively, to the first and the last base unit of said stacked plurality of base units, each of said coupling flanges having a relatively large central aperture for communication with said shell flow space and at least one, lateral, smaller, aperture for communication with said headers, wherein said base units are attachable to one another in a first mode, in which said at least two partition walls are respectively aligned throughout the entire module and said headers are consequently connected in parallel, and in a second mode, in which some of said base units are angularly offset with respect to other units, facilitating serial connection of at least portions of said headers, each module further comprising end caps each provided with a coupling flange sealingly attachable to the coupling flanges at the free ends of said module to modules, said end caps being further provided with a first pipe socket leading into a first space communicating via the central aperture of said coupling flanges with said shell slow space, and with a second pipe socket leading into a second space communicating via the lateral apertures in said coupling flanges with one of said headers, said first and said second space being isolated from each other by sealing means, and means to sealingly press together each two of said coupling flanges.

7. The heat exchanger as claimed in claim 6, wherein said sealing means are profiled, hooplike straps straddlingly appliable to the tapering rear surfaces of said second portions of each pair of contacting coupling flanges, tightening of which hoop-like clamping means sealingly forces the flanges of each such pair against each other.

8. A module for a cross flow, tube and shell, type heat exchanger comprising:

a stacked plurality of base units having a first and a last unit, each base unit including a substantially flat double frame having a shape and consisting of an inner frame member delimiting an opening defining an element of a shell flow space, an outer frame member surrounding at least a portion of said inner member at a distance, which distance defines an element of a header flow space, at least two partition walls connecting said inner and said outer frame members and dividing said header element into an inlet header element and an outlet header element, said inlet and said outlet element being thereby separated from each other, a plurality of juxtaposed tubular members extending from one side of said opening to another side thereof, the spacing of said juxtaposed tubular members being such as to leave a clearance therebetween, one end of each of said tubular members communicating with said inlet header element and the other end of each of said tubular members communicating with said outlet header element, each base unit sealingly and fixedly attached to one another at the frames thereof, inner frame member to inner frame member, outer frame member to outer frame member, whereby said shell flow space elements become interconnected to form a shell flow space and said header elements become interconnected to form headers, further comprising two coupling flanges sealingly and fixedly attached, respectively, to the first and the last base unit of said stacked plurality of base units, each of said coupling flanges having a relatively large central aperture for communication with said shell flow space and at least one, lateral, smaller, aperture for communication with said headers, wherein said base units are attachable to one another in a first mode, in which said at least two partition walls are respectively aligned throughout the entire module and said headers are consequently connected in parallel, and in a second mode, in which some of said base units are angularly offset with respect to other units, facilitating serial connection of at least portions of said headers.

9. The module as claimed in claim 8, wherein two or more of said modules are interconnectable by being coupled to one another with the aid of said coupling flanges.

10. The module as claimed in claim 8, wherein, in the axial direction, said coupling flanges have a first portion conforming in shape to the shape of said frame, whereby said flanges are sealingly and fixedly attachable to said base unit, and a second portion, substantially ring-shaped, whereby said flanges are attachable to other coupling flanges.

11. The module as claimed in claim 10 wherein the clamping rear surface of said substantially ring-shaped coupling flange portion tapers outwardly and towards the coupling front surface of said flange.

12. The module as claimed in claim 11, including means to sealingly press together each two of said coupling flanges, said means are profiled, hooplike straps straddlingly appliable to the tapering rear surfaces of said second portions of each pair of contacting coupling flanges, tightening of which hoop-like clamping means sealingly forces the flanges of each such pair against each other.

* * * * *